US006953042B2

(12) United States Patent
Jur et al.

(10) Patent No.: US 6,953,042 B2
(45) Date of Patent: Oct. 11, 2005

(54) APPARATUS AND PROCESS FOR SUPERCRITICAL CARBON DIOXIDE PHASE PROCESSING

(75) Inventors: Jesse Stephen Jur, Cayce, SC (US); Kenneth J. McCullough, Fishkill, NY (US); Wayne Martin Moreau, Wappingers Falls, NY (US); John Patrick Simons, Wappingers Falls, NY (US); Charles Jesse Taft, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/295,531

(22) Filed: Nov. 15, 2002

(65) Prior Publication Data

US 2003/0066544 A1 Apr. 10, 2003

Related U.S. Application Data

(62) Division of application No. 09/546,355, filed on Apr. 10, 2000, now Pat. No. 6,558,475.

(51) Int. Cl.[7] ..... B08B 3/00

(52) U.S. Cl. ..... 134/56 R; 134/95.1; 134/18; 134/26; 134/30; 134/31

(58) Field of Search ..... 8/158, 159, 142; 134/12, 10, 107, 18, 26, 30, 31, 34, 35, 56 R, 134/95.1; 68/18 C, 18 F, 139, 140, 183, 207

(56) References Cited

U.S. PATENT DOCUMENTS 2,617,719 A 11/1952 Stewart
4,788,043 A 11/1988 Kagiyama et al.
4,879,044 A 11/1989 Feimer et al.
4,944,837 A 7/1990 Nishikawa et al.
5,011,542 A 4/1991 Weil
5,013,366 A 5/1991 Jackson et al.
5,068,040 A 11/1991 Jackson
5,143,103 A 9/1992 Basso et al.
5,182,296 A 1/1993 Nakai et al.
5,377,705 A 1/1995 Smith, Jr. et al.
5,474,877 A 12/1995 Suzuki
5,665,527 A 9/1997 Allen et al.
5,806,120 A * 9/1998 McEachern ..... 8/158
5,908,510 A 6/1999 McCullough et al.
5,970,554 A * 10/1999 Shore et al. ..... 8/158

* cited by examiner

*Primary Examiner*—M. Kornakov
(74) *Attorney, Agent, or Firm*—Ohlandt, Greeley, Ruggiero & Perle, L.L.P.; Daniel P. Morris, Esq.

(57) ABSTRACT

The present invention provides an apparatus for cleaning a workpiece with a cleaning medium that is maintained at a single fluid phase. The apparatus comprises means for providing the cleaning medium; a pressurizable cleaning vessel for receiving the cleaning medium and the workpiece; and means for maintaining a single fluid phase of the cleaning medium in the cleaning vessel. The present invention further provides a process for cleaning the workpiece with cleaning medium under conditions such that the workpiece is exposed to a single fluid phase of the cleaning medium. The present invention further includes a process for a storage media that includes instructions for controlling a processor for the process of the present invention. The storage media comprises means for controlling the processor to control contacting conditions of the workpiece and the cleaning medium such that the workpiece is exposed to a single fluid phase of the cleaning medium.

4 Claims, 3 Drawing Sheets

APPARATUS AND PROCESS FOR SUPERCRITICAL CARBON DIOXIDE PHASE PROCESSING

This is a division, of application Ser. No. 09/546,355, filed on Apr. 10, 2000 now U.S. Pat. No. 6,558,475.

BACKGROUND OF THE INVENTION

1. Field of the Invention

The present invention relates to an apparatus and process for cleaning a workpiece with a cleaning medium maintained at a single fluid phase under conditions such that the workpiece is exposed to a single fluid phase of the cleaning medium. More particularly, the present invention relates to an apparatus and process for cleaning a workpiece with carbon dioxide and a co-solvent under conditions such that the workpiece is exposed to a single fluid phase of the carbon dioxide and co-solvent.

2. Description of the Prior Art

Fluid heated to above the critical temperature, i.e., the temperature above which a gas cannot be liquefied by an increase in pressure, is known as supercritical fluid. This fluid can move between the state of high density and that of low one without phase transition. Since the supercritical fluid can change density continuously, the slight change of temperature or pressure can manipulate the thermodynamic and transport properties of the fluid. Water fluid, as an example, changes the dielectric constant from about 78 at room temperature and atmospheric pressure to roughly 6 at 647° K (the critical temperature) and 220 atm. (the critical pressure). The character of water fluid changes from one that supports only ionic species to one that dissolves even paraffins and aromatics.

Due to this unique dielectric behavior property, numerous fundamental and applied research endeavors have been directed to reaction and separation processes that employ supercritical fluids, especially those that are associated with the environment. Supercritical fluids such as water and carbon dioxide are compatible with the earth's environment. Some applications and uses of supercritical fluids of carbon dioxide ($SCFCO_2$) in processing solids and liquids are described in Chemical and Engineering News, June 1999, pages 11–13.

It has long been desirable to remove, in a precise and repeatable manner, organic, particulate and ionic contamination in developed resist films from components and assemblies without the use of water rinses or extensive post-cleaning drying. Carbon dioxide, either alone or in combination with other solvents, has been used to carry out such cleaning.

U.S. Pat. No. 5,377,705 describes a system for cleaning a workpiece with a multi-phase cleaning medium. However, when this apparatus is used to clean developed resist of sub 100 nm size (nano-images) in a multi-phase carbon dioxide, image collapse occurs. The liquid $CO_2$ in the a multi-phase cleaning medium, being of higher surface tension than the supercritical phase, exerts an undesirable physical force on the developing image, thereby inducing image collapse.

U.S. Pat. No. 5,013,366 discloses a cleaning process using dense phase gases and phase shifting, i.e., shifting to and from the supercritical phase. In this process, carbon dioxide is the preferred dense phase gas, which may be mixed with co-solvents, such as anhydrous ammonia gas, and compressed to the supercritical fluid phase. This patent also discloses the use of carbon dioxide, co-solvents, and ultrasonic energy to enhance cleaning.

U.S. Pat. No. 5,068,040 discloses the excellent solvent/oxidant properties of supercritical ozone dissolved in liquid or supercritical carbon dioxide or water in dissolving and/or oxidizing inorganic materials. However, the presence of water presents problems with water recycling and disposal.

U.S. Pat. No. 2,617,719 discloses a process and apparatus for cleaning porous media, such as oil-bearing sandstone. The cleaning cell is supplied with a solvent and a dissolved gas, such as carbon dioxide. Used solvent is vented to the atmosphere. Solvent venting creates hazards to the environment that are unacceptable by today's standards.

Additional cleaning, extracting and stripping process are disclosed in U.S. Pat. Nos. 4,879,004; 5,011,542; 4,788,043 and 5,143,103.

The removal of selected portions of pattern films, as a form of semiconductor processing in forming high-resolution images, is a particularly useful application of a supercritical fluid. This is described in U.S. Pat. Nos. 4,944,837; 5,185,296 and 5,665,527.

Of particular concern is the inability to attain high aspect ratio images, i.e., height to width of image ratio. In general, aqueous based developers exert a high surface tension force, which causes images of <150 nm to fold inwardly. This problem has been described by Tanaka in Japanese J. Appl. Physics, vol. 32, pages 6059–6064 (1995). The image collapse is caused by the high surface tension of water (80 dynes/cm) exerting a physical force on the fragile lines/space patterns of resist. Thus, a lower surface tension developer would be advantageous to use.

Although a lower surface tension developer, such as heated water, has been described in U.S. Pat. No. 5,474,877, the surface tension of this system is still above 50 dynes/cm in the developer/rinse process.

Supercritical fluid of $CO_2$ has been utilized as a resist developer. The use of supercritical fluid of $CO_2$ is particularly advantageous in that the surface tension of $SCFCO_2$ is less than 20 dynes/cm (see Jacobsen, J. Org. Chem., volume 64, pages 1207–1210 (1999)).

We have found that when the apparatus described in the previously cited U.S. Pat. No. 5,377,705 is used to develop resist in $SCFCO_2$ of sub 100 nm size, i.e., nano-images, image collapse occurs. In the processing of the resist-coated wafer according to this patent, the developer chamber is pre filled with liquid $CO_2$ and not $SCFCO_2$. The liquid $CO_2$ is then converted into $SCFCO_2$ phase by heating to 31° C. and a 73.8 bar pressure. Being of higher surface tension, the liquid $CO_2$ exerts an undesirable physical force on the developing image, thereby inducing image collapse.

It would be advantageous to introduce $SCFCO_2$ having a lower surface tension into the process vessel for developing resist or for improved cleaning of wafers and reactive ion etch or other semiconductor process residues, such as those described in U.S. Pat. No. 5,908,510.

SUMMARY OF THE INVENTION

It is an object of the present invention to provide an apparatus for cleaning a workpiece with a cleaning medium maintained at a single fluid phase.

It is another object of the present invention to provide a process for cleaning a workpiece with a cleaning medium under conditions such that the workpiece is exposed to a single fluid phase of the cleaning medium.

It is a further object of the present invention to provide storage media including instructions for controlling a processor for cleaning a workpiece with a cleaning medium under conditions such that the workpiece is exposed to a single fluid phase of the cleaning medium.

Accordingly, the present invention provides an apparatus for cleaning a workpiece with a cleaning medium maintained at a single fluid phase. The apparatus comprises means for providing the cleaning medium; a pressurizable cleaning vessel for receiving the cleaning medium and the workpiece; and means for maintaining a single fluid phase of the cleaning medium in the cleaning vessel.

The present invention further provides a process for cleaning a workpiece with a cleaning medium maintained at a single fluid phase of the cleaning medium. The process comprises contacting the workpiece and the cleaning medium in a cleaning vessel under conditions such that the workpiece is exposed to a single fluid phase of the cleaning medium, wherein contacting is carried out for a period of time sufficient to clean the workpiece.

The present invention still further provides a storage media including instructions for controlling a processor for cleaning a workpiece with a cleaning medium. The storage media comprises means for controlling the processor to control contacting conditions of the workpiece and the cleaning medium such that the workpiece is exposed to a single fluid phase of the cleaning medium, wherein contacting is carried out for a period of time sufficient to clean the workpiece.

The present invention provides several advantages. Flushing under the single fluid phase conditions reduces the concentration of co-solvents and contaminants in the vessel and reduces the potential for re-deposition of co-solvent and contaminants on the workpiece during depressurization of the vessel. The apparatus of the present invention also permits precision removal of organic, particulate and ionic contamination and development of resist films from components and assemblies without the use of water rinses or extensive post-cleaning drying. The present invention further allows the use of co-solvents with minimal contamination of the workpiece by the co-solvent. It also allows separation and concentration of carbon dioxide for recycling into the process. It further allows separation and concentration of the co-solvent and contaminants and facilitates their handling, storage and disposal and avoids their release into the environment.

Further features, objects and advantages of the present invention will become apparent from the following detailed description made with reference to the drawings.

DETAILED DESCRIPTION OF THE INVENTION

Figure 1:
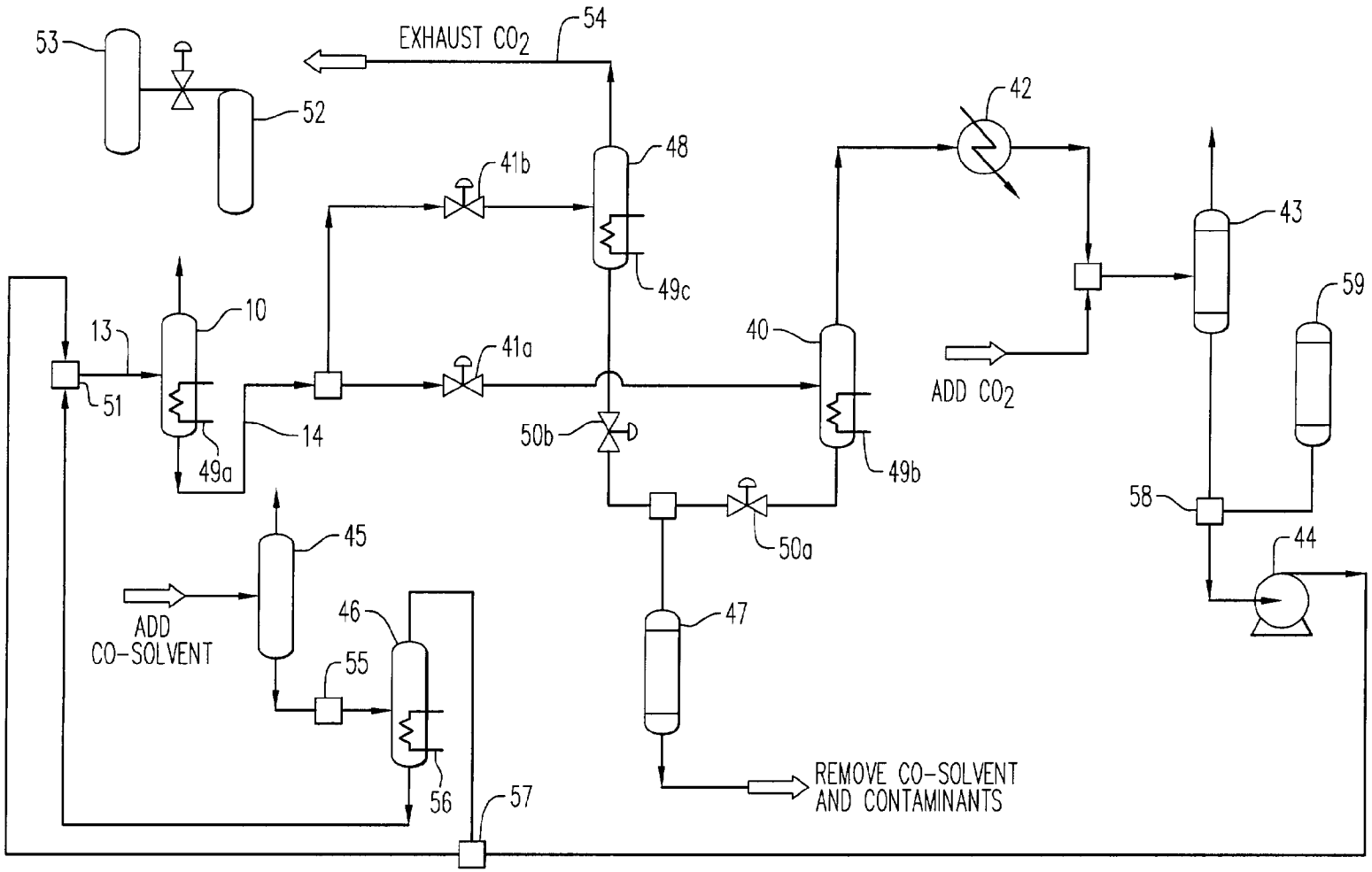
FIG. 1 is a schematic of an apparatus for precision cleaning according to the present invention.

The present invention includes a process for cleaning a workpiece with a cleaning medium under conditions that expose the workpiece to a single fluid phase of the cleaning medium.

The key step of the process of the present invention is the step of contacting the workpiece and the cleaning medium in a cleaning vessel under conditions such that the workpiece is exposed to a single fluid phase of the cleaning medium. Contacting is carried out for a period of time sufficient to clean the workpiece.

To carry out this step, inert gas is introduced into the cleaning vessel and the cleaning vessel is maintained at a selected target temperature and pressure, i.e., under conditions that are sufficient to produce a single fluid phase. Inert gas is introduced into a solvent delivery vessel, then a co-solvent and carbon dioxide are introduced into the solvent delivery vessel to form a cleaning medium, which is at the single fluid phase, and the solvent delivery vessel is maintained at a temperature and pressure sufficient to produce a single fluid phase. Prior to introduction of the cleaning medium to the cleaning vessel, the cleaning vessel is purged with a purge gas. The cleaning vessel and the workpiece are then flushed with carbon dioxide that is in the single fluid phase. After the cleaning step, inert gas is introduced into the cleaning vessel to remove the cleaning medium and the pressure of the cleaning vessel is adjusted to atmospheric pressure and the workpiece is removed from the cleaning vessel.

In one embodiment, a co-solvent is placed in a solvent delivery vessel and at least one workpiece is placed in the cleaning vessel. The cleaning vessel is then pressurized to a target pressure by adding inert gas to the vessel. Once the target temperature and pressure are reached, carbon dioxide is introduced to the co-solvent delivery vessel until the target temperature and pressure is reached. At this point the co-solvent delivery vessel contents are introduced into the cleaning vessel. Additional carbon dioxide is then pumped through the vessel while maintaining the target pressure to flush the contents of the vessel. The flushing reduces the concentration of co-solvents and contaminants in the vessel and reduces the potential for re-deposition of co-solvent and contaminants on the workpiece during depressurization of the vessel According to a preferred embodiment, the cleaning vessel is purged with a purge gas prior to introduction of the co-solvent. In still another preferred embodiment, the workpiece and/or the co-solvent is mechanically agitated during the residence period.

It is preferable that the target pressure be above the supercritical pressure of at least one fluid component in the cleaning vessel, usually, the carbon dioxide.

It is also preferable to direct the fluid contents of the cleaning vessel to a regeneration circuit for separating co-solvent and contaminants from the carbon dioxide.

In another preferred embodiment, the process includes the steps of pre and post pressurization using an inert gas. This provides a non-reactive process for making pressure and/or temperature changes to the workpiece and/or cleaning vessel and/or co-solvent delivery vessel.

In still another preferred embodiment of the process, an inert gas is introduced into the cleaning vessel containing a workpiece; the cleaning medium is introduced into the cleaning vessel; the workpiece and the cleaning medium are contacted in a single fluid phase for a period of time sufficient to clean the workpiece; inert gas is introduced into the cleaning vessel after the contacting step to remove the cleaning medium; and the pressure of the cleaning vessel is adjusted to atmospheric pressure.

In yet another preferred embodiment of the process, a solvent delivery vessel and a cleaning vessel are provided; the workpiece is placed in the cleaning vessel; inert gas is introduced into the cleaning vessel; the cleaning vessel is maintained at a first temperature and first pressure, the first temperature and the first pressure being sufficient to produce a single fluid phase in the cleaning vessel; inert gas is introduced into the solvent delivery vessel; carbon dioxide and optionally co-solvent is introduced to the solvent delivery vessel to form the cleaning medium; solvent delivery vessel is maintained at a second temperature and second pressure, the second temperature and second pressure being sufficient to produce the single fluid phase in the solvent delivery vessel; the cleaning medium is introduced into the cleaning vessel; the workpiece and the cleaning medium are contacted in the single fluid phase for a period of time sufficient to clean the workpiece; inert gas is introduced into the cleaning vessel after the contacting step to remove the cleaning medium; and the pressure of the cleaning vessel is adjusted to atmospheric pressure.

Preferably, the first pressure of the cleaning vessel and the second pressure of the solvent delivery vessel is controlled by the use of inert gas and the first temperature of the cleaning vessel and the second temperature of the solvent delivery vessel is controlled by heating.

In the supercritical phase, carbon dioxide can be compressed to near liquid densities, where it displays good solubilizing properties, favorable mass transport characteristics, low viscosity and high diffusivities, making supercritical carbon dioxide an effective solvent for many molecular non-hydrogen bonding organic substances. However, supercritical carbon dioxide cannot remove all contaminants. Hence, there is a need to add co-solvents to the carbon dioxide, and this need is addressed by the cleaning medium of the present invention. Accordingly, the cleaning medium is preferably a mixture of carbon dioxide and co-solvent and the single fluid phase is liquid, gas or supercritical fluid phase. However, the cleaning medium must be in a single fluid phase prior to contacting the workpiece.

Any suitable solvent can be used as the co-solvent component in the cleaning medium of the present invention. Co-solvents that are soluble in carbon dioxide are preferred. Suitable co-solvents include, for example, hydrocarbons, such as saturated hydrocarbons, unsaturated hydrocarbons and aromatic hydrocarbons; halogenated hydrocarbons, such as chlorocarbons, fluorocarbons, including chloroform, methylene chloride and trichlorotrifluoroethane; amines, such as dimethylamine, diethylamine, triethylamine, ethanolamine and aniline; amides, such as N,N-dimethylformamide, N,N-dimethylacetamide and N-methylpyrrolidone; aldehydes, such as benzaldehyde; acids, such as acetic acid; anhydrides, such as acetic anhydride; nitriles, such as acetonitrile; sulfoxides, such as dimethylsulfoxide; silicon containing compounds, such as triethoxysilane, hexamethyldisilazane, cyclooctatetrasiloxane; alcohols, such as methanol, ethanol, 1-propanol and 2-propanol; ketones, such as acetone and methyl ethyl ketone; esters, such as ethyl acetate and butyl acetate, including lactones; ethers; and a mixture thereof.

The most preferred co-solvents include heptane, benzene, acetic acid, methanol, 2-propanol, ethanolamine, dimethylsulfoxide, N,N-dimethylformamide and N-methylpyrrolidone.

Preferably, each of the first pressure and the second pressure is above the supercritical pressure of at least one fluid component and/or above the supercritical pressure of carbon dioxide.

The present invention further includes an apparatus, or a system, for cleaning a workpiece with a cleaning medium maintained at a single fluid phase, which can be used to carry out the above process. The apparatus comprises means for providing a cleaning medium, a pressurizable cleaning vessel for receiving the cleaning medium and the workpiece and means for maintaining a single fluid phase of the cleaning medium in the cleaning vessel.

Means for providing the cleaning medium includes a storage vessel for maintaining a supply of carbon dioxide, a storage vessel for maintaining a supply of inert gas, a co-solvent supply vessel, a pressurizable solvent delivery vessel for forming and delivering the cleaning medium, means for providing inert gas to the solvent delivery vessel, means for controlling the temperature of the solvent delivery vessel and an agitator for mixing carbon dioxide and the co-solvent in the solvent delivery vessel.

Means for maintaining a single fluid phase of the cleaning medium includes means for controlling the temperature of the cleaning vessel.

The apparatus also includes a cleaning vessel for receiving the workpiece. The cleaning vessel has an inlet and an outlet. The outlet is preferably near or in the bottom of the vessel. A letdown valve is in communication with the outlet and may be manipulated to assist in control of the pressure in the vessel and for draining the vessel. A heater is provided for controlling the temperature of the cleaning medium in the cleaning vessel. A separator is in communication with the letdown valve having a first outlet near the upper end and a second outlet at a lower end of the separator. The temperature and pressure of the separator vessel are controllable to effect the separation of carbon dioxide and the co-solvent. A condenser is in communication with the separator's first outlet for condensing gaseous cleaning medium to a liquid state. A storage vessel maintains a supply of the liquid cleaning medium. A pump conveys the cleaning medium from the storage vessel to the co-solvent delivery vessel and/or the cleaning vessel. The co-solvent delivery vessel is in communication with the co-solvent supply vessel. The co-solvent delivery vessel is in communication with a pump and the cleaning vessel such that the cleaning medium can be passed through the co-solvent delivery vessel to carry co-solvent into the cleaning vessel. The system is arranged so that the liquid cleaning medium and co-solvent are premixed (stirred) in the solvent delivery vessel, heated and pressurized to the required processing phase (liquid, gas, or supercritical).

Typically, the cleaning vessel pressure will be obtained using inert gas until the target pressure is reached. The solvent delivery system will then introduce cleaning medium having a co-solvent to the cleaning vessel. During processing, a constant flow is maintained so that the cleaning medium is removed from the cleaning vessel through the letdown valve to pass the cleaning medium to the separator.

Typically, the pressure in the separator will be about 500 psi. The cleaning medium thereafter passes through the separator outlet to the condenser and back to the liquid storage vessel. The separated co-solvent and contaminants collect in the lower end of the separator for removal through the second outlet. After the process period, the letdown of the cleaning vessel is performed in two steps. Step one provides for replacement of process fluid with an inert gas at process temperature and pressure. Step two allows for depressurization of the cleaning vessel to atmospheric pressure in an inert environment and at ambient temperature.

In a preferred embodiment, the apparatus according to the present invention comprises a storage vessel for maintaining a supply of carbon dioxide; a storage vessel for maintaining a supply of inert gas; co-solvent supply vessel; a pressurizable solvent delivery vessel for forming and delivering the cleaning medium; a pressurizable cleaning vessel for receiving the workpiece, the pressurizable cleaning vessel having an inlet for receiving the cleaning medium from the solvent delivery vessel and an outlet from the cleaning vessel; a letdown valve in communication with the outlet; means for placing the solvent delivery vessel in communication with the co-solvent supply vessel; means for controlling the temperature of the solvent delivery vessel; means for controlling the temperature of the cleaning vessel; an agitator for mixing carbon dioxide and the co-solvent in the solvent delivery vessel; means for conveying at least one of carbon dioxide and inert gas from the storage vessels for maintaining a supply of carbon dioxide or the inert gas to the solvent delivery vessel and the cleaning vessel; a first valve and a second valve in communication with the means for conveying at least one of carbon dioxide an inert gas; the first valve being in communication with the storage vessel for maintaining a supply of carbon dioxide and the storage vessel for maintaining a supply of the inert gas; the second valve being in communication with the solvent delivery vessel; and a third valve; the third valve being in communication with the second valve, solvent delivery vessel and the cleaning vessel for conveying one or more of the cleaning medium, carbon dioxide and the inert gas to the cleaning vessel.

The apparatus can further include a separator means, in communication with the letdown valve, having a first outlet and a second outlet at a lower end of the separator means and means for condensing vapors to a liquid fluid phase, in communication with the first outlet of the separator means.

One embodiment of the apparatus according to the present invention for carrying out single fluid phase processing is shown in FIG. 1. The apparatus includes a pressurizable cleaning vessel 10 and a pressurizable solvent delivery vessel 46. These vessels 10 and 46 are constructed to withstand operating pressures from about 900 to about 5,000 psig and temperatures up to about 85° C.

The cleaning vessel 10 and the solvent delivery vessel include mechanical stirring for improved agitation of process solvent.

An inlet 13 admits cleaning medium to the pressure vessel, and cleaning medium, such as cleaning is withdrawn through outlet 14. A removable filter (not shown) is located in line with outlet 14 for filtering particulate matter from the spent cleaning medium. A suitable workpiece rack (not shown) is provided for holding one or more workpiece (not shown) in a secure manner.

Referring again to FIG. 1, the cleaning vessel 10 empties to a separator 40, and flow between cleaning vessel 10 and separator 40 is controlled by a flow control valve 41*a*. Separator 40 is also in communication with a condenser 42, which condenses the carbon dioxide issuing from separator 40 for storage in a carbon dioxide liquid storage vessel 43.

Carbon dioxide is removed from the storage vessel 43 by a pump 44 for introduction to the cleaning vessel 10. A solvent delivery system, including a solvent storage vessel 45 and a solvent delivery vessel 46, is also in communication with cleaning vessel 10. Clean solvent is provided in the storage vessel 45. Measured amounts of the solvent are delivered to delivery vessel 46. Once delivered, this vessel can be prepared by introducing $CO_2$ by valve 57 and pump 44 until target pressure and temperature are achieved. The delivery system can then be isolated until the actual process solvent is required in the cleaning vessel 10.

The system also includes an auxiliary separator 48 having a vent 54 for venting carbon dioxide to the atmosphere. The cleaning vessel 10, the solvent delivery vessel 46, the separator 40 and the auxiliary separator 48 are all equipped with heating elements 49*a*, 49*b*, 49*c* and 56, which control the temperature in the vessels. Valves 50*a* and 50*b* control flow from the separators 40 and 48 to the recycle vessel 47. Two-way valve 51 directs either carbon dioxide or carbon dioxide-solvent mixture to the vessel 10.

The system may also include a pre-cleaning vessel 52 having its own dedicated pre-dipped solvent storage vessel 53 for pre-cleaning the workpiece prior to introducing the workpiece into the cleaning vessel 10. The system may also include a plurality of solvent storage and solvent delivery vessels, each for supplying a discrete solvent to the cleaning vessel 10.

The apparatus is designed to support processes such as semiconductor resist develop, reactive ion etch and other process residues. The apparatus according to the present invention reduces or eliminates the use of environmentally hazardous solvents, water rinses, and post-cleaning drying. Additionally, it limits exposure of the workpiece to the co-solvent and provides separation and concentration of carbon dioxide for recycling into the process as well as separation and concentration of co-solvent and contaminants to facilitate handling, storage, and disposal.

Workpieces to be cleaned are placed into a carrier, which is then placed into the cleaning vessel 10. The cleaning vessel is then pressurized by operating valve 58 to introduce inert gas to the suction side of pump 44. Pump 44 then pressurizes cleaning vessel 10 through valve 57 and valve 51 via inlet 13. During this period, the target temperature is obtained on each of the heater elements 49.

After the target pressure is reached, the previously prepared solvent delivery system is introduced. The inert gas source is shut by operating valve 58 and closing valve 51. This provides liquid $CO_2$ to the inlet of pump 44. Outlet of the pump can now be sent to solvent delivery vessel 46 or directly to the cleaning vessel 10 (if no co-solvent is desired).

In the case a co-solvent is required, valve 57 is operated. Upon confirmation that this vessel is at temperature and pressure, valve 51 is operated providing mixture delivery to the cleaning vessel 10. The fluid inside the cleaning vessel 10 is continuously flushed. Clean carbon dioxide is pumped into the cleaning vessel 10 while contaminated carbon dioxide is removed.

The dissolved contaminants and the spent carbon dioxide continuously flow from the cleaning vessel 10 to the separator 40. The pressure in the separator is below that of the cleaning vessel 10 so that no additional pumping is required. The pressure in the separator 40 is further adjusted so that the contaminant comes out of solution in the carbon dioxide and is captured in the separator.

Control of the pressure and temperature of the contents of the separator required for effective separation, i.e., removal of carbon dioxide with as little co-solvent vapor as possible. Relatively clean carbon dioxide continues to flow from the separator 40 and is condensed in a condenser 42 and placed in storage vessel 43 for reuse. Particulates are captured in filters located in both the cleaning vessel 10 and separator 40.

After the target pressure is reached in the vessel 10, the valve 41*a* is opened and the valve 41*a*, in combination with pump 44 and heater 49, is controlled to maintain the target pressure and temperature within cleaning vessel 10, with the flow through the vessel being continuous. A predetermined number of exchanges are carried out through a given cycle time, usually 15 to 60 minutes. Each exchange theoretically provides complete replacement of the fluid in the cleaning vessel 10.

After the predetermined number of exchanges is completed, the solvent is displaced with the inert gas maintaining temperature and pressure. Valve 41*a* is closed along with operating valves 57 and 58. The system is now operated to complete recovery of remaining contaminate, co-solvent and $CO_2$ by opening 41*a* in a pressure control mode for a period of time to provide for solvent displacement. Once solvent displacement has been completed, the system can be let-down, the valve 41*a* opened further and pump 44 turned off to begin a let down of pressure in the cleaning vessel 10. Once the cleaning vessel 10 reaches a predetermined minimum pressure, such as 500 psi, valve 41*a* is closed and valve 41*b* is opened to vent the cleaning vessel through auxiliary separator 48 and vent 54 directly to the atmosphere. This maintains the pressure in the system downstream of the cleaning vessel 10 in excess of 500 psi, for example.

The present invention further includes a storage media including instructions for controlling a processor for the process of the present invention. The processor can control each of the process steps. The storage media comprises means for controlling the processor to control contacting conditions of the workpiece and the cleaning medium such that the workpiece is exposed to a single fluid phase of the cleaning medium.

Figure 2:
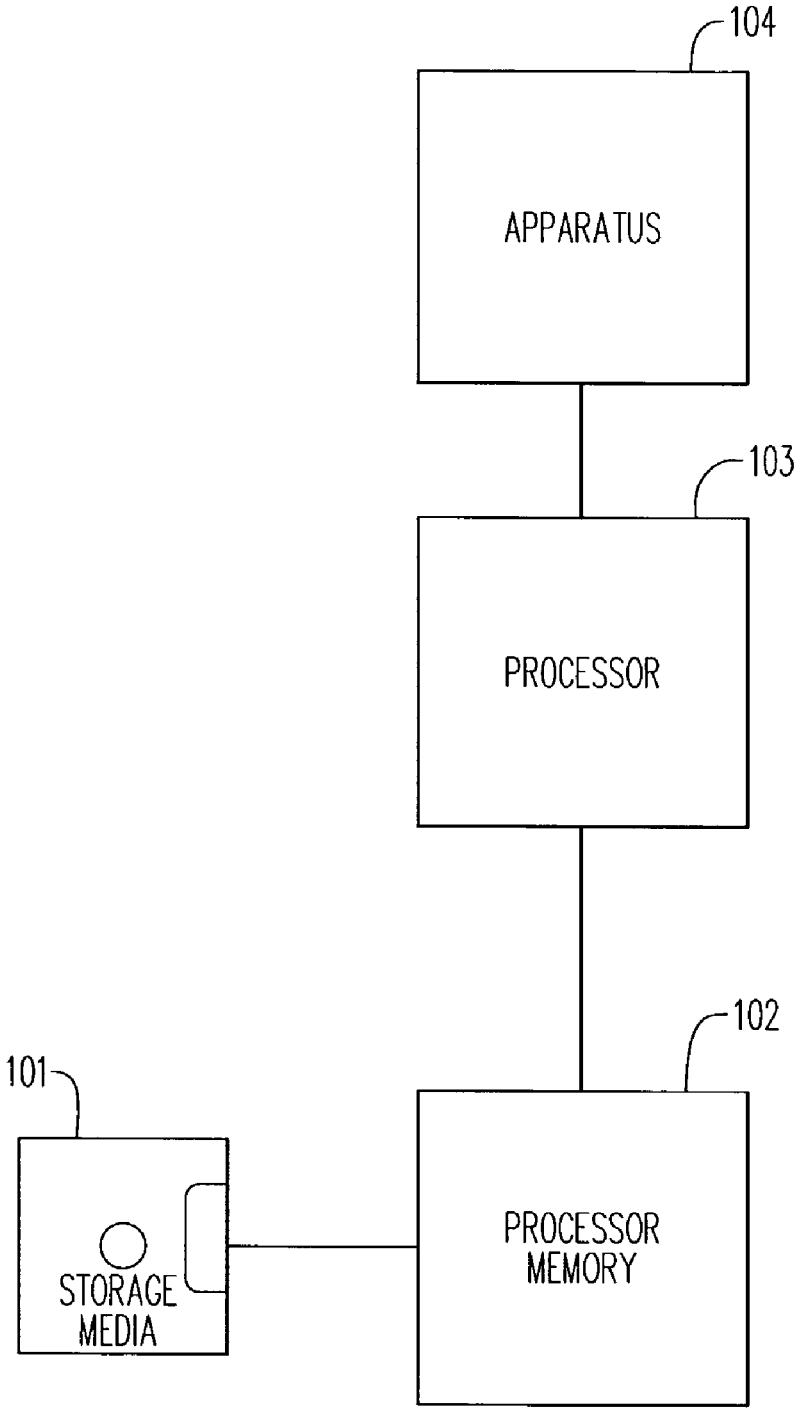
FIG. 2 is a schematic of a storage media for the cleaning process of the present invention.

Referring to FIG. 2, processor memory 102 contains data and instructions for execution of the process of the invention by electronic processor 103. In particular, processor memory 102 includes the data and instructions required to enable electronic processor 103 to execute the steps of the process for control of the apparatus 104 described hereinafter and illustrated in FIG. 1. Processor 103 and processor memory 102 can be implemented in hardware, using discrete circuitry or firmware, or they can be part of a general purpose computer, such as a PC. While the procedures required to execute the invention hereof are indicated as already loaded into processor memory 102, they may be configured on a storage media 101, such as data memory, for subsequent loading into processor memory 102.

Figure 3:
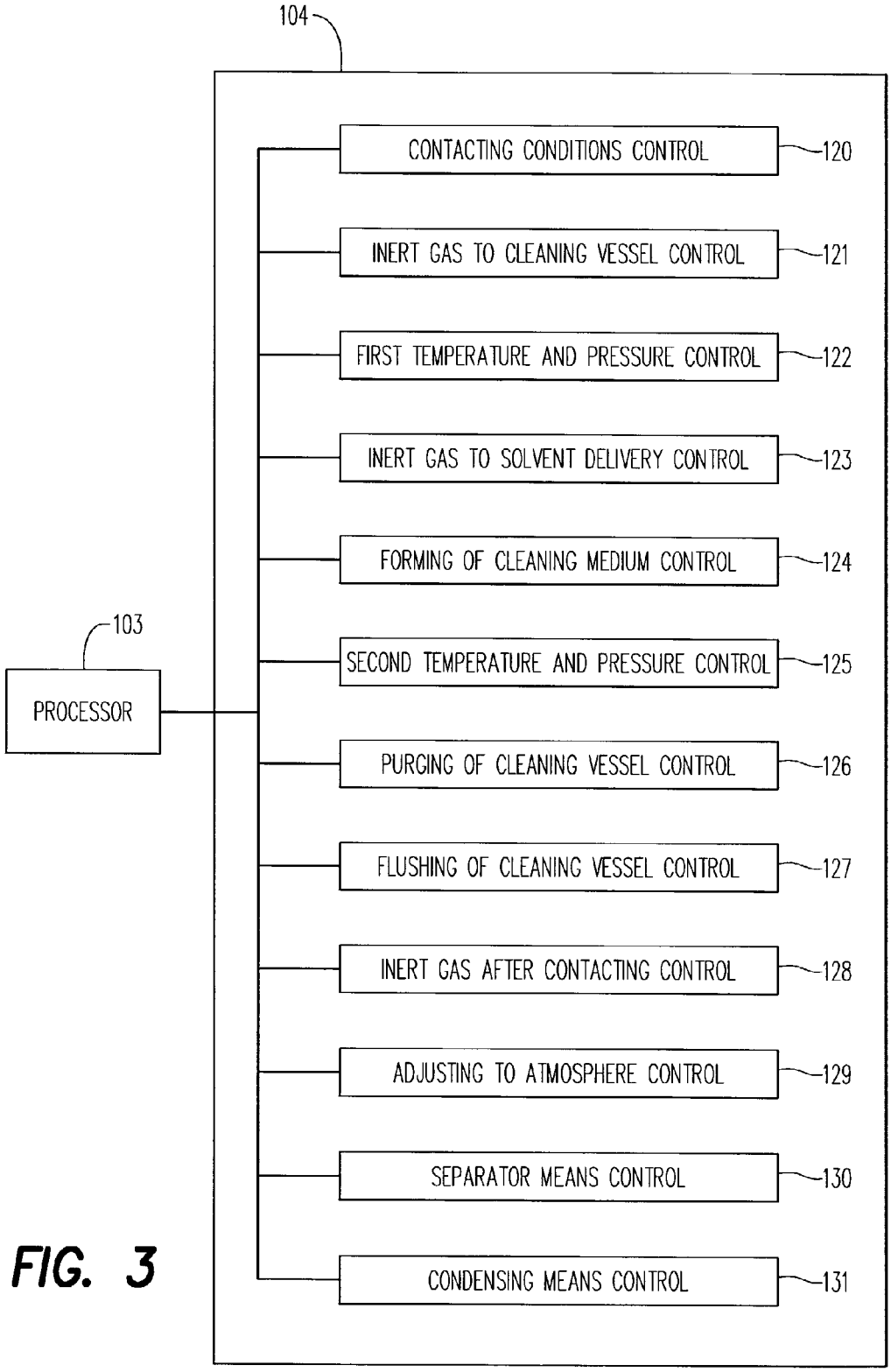
FIG. 3 is a schematic of the processor-controlled cleaning apparatus and process of the present invention.

Referring to FIG. 3, processor 103 executes the steps of the process carried out in apparatus 104 by control of:

means 120 for controlling contacting conditions of the workpiece and the cleaning medium such that the workpiece is exposed to a single fluid phase of the cleaning medium, wherein the contacting is carried out for a period of time sufficient to clean the workpiece;

means 121 for controlling introduction of inert gas into the cleaning vessel;

means 122 for controlling maintaining of the cleaning vessel at a first temperature and first pressure;

means 123 for controlling introduction of inert gas into a solvent delivery vessel;

means 124 for controlling introduction of carbon dioxide and optionally co-solvent to the solvent delivery vessel to form a cleaning medium at the single fluid phase;

means 125 for controlling maintaining of the solvent delivery vessel at a second temperature and second pressure;

means 126 for controlling purging of the cleaning vessel with a purge gas prior to introduction of the cleaning medium;

means 127 for controlling flushing of the cleaning vessel and the workpiece with carbon dioxide in the single fluid phase;

means 128 for controlling introduction of inert gas into the cleaning vessel after the contacting step to remove the cleaning medium;

means 129 for controlling adjusting of the pressure of the cleaning vessel to atmospheric pressure;

means 130 for controlling a separator means; and means 131 for controlling means for condensing vapors to a liquid fluid phase.

The present invention can be used in cleaning wafers that are adversely affected by exposure to liquid carbon dioxide prior to a supercritical phase treatment. Applications include photoresist development using supercritical carbon dioxide and optionally a co-solvent. The present invention provides that carbon dioxide is in a single fluid phase and that the single fluid phase is maintained throughout the process.

The present invention has been described with particular reference to the preferred embodiments. Variations and modifications thereof could be devised by those skilled in the art without departing from the spirit and scope of the present invention. The present invention embraces all such alternatives, modifications and variations that fall within the scope of the present invention as defined by the appended claims.

We claim:

1. A storage media including instructions for controlling a processor for cleaning a workpiece with a cleaning medium, said storage media comprising:

means for controlling said processor to control contacting conditions of said workpiece and said cleaning medium based on the instructions to execute cleaning of workpiece with sequential processing steps to include establishing a set of cleaning conditions in a cleaning vessel prior to supplying the cleaning medium; supplying the cleaning medium into the cleaning vessel, the cleaning medium being at said set of cleaning conditions; removing the cleaning medium from the cleaning vessel and maintaining the cleaning vessel at said set of cleaning conditions for a period of time, thus exposing said workpiece only to a single fluid phase during cleaning, wherein said contacting is carried out for a period of time sufficient to clean said workpiece.

2. The storage media of claim 1, wherein said means for controlling said processor to control said contacting conditions comprising:

means for controlling said processor to introduce inert gas into the cleaning vessel;

means for controlling said processor to introduce carbon dioxide and optionally co-solvent to a solvent delivery vessel to form a cleaning medium at said single fluid phase;

means for controlling said processor to introduce inert gas into said cleaning vessel after said contacting step to remove said cleaning medium; and means for controlling said processor to adjust the pressure of said cleaning vessel to atmospheric pressure.

3. The storage media of claim 1, wherein said means for controlling said processor to control said contacting conditions further comprising:

means for controlling said processor to introduce inert gas into the cleaning vessel;

means for controlling said processor to maintain said cleaning vessel at a first temperature and first pressure;

means for controlling said processor to introduce inert gas into a solvent delivery vessel;

means for controlling said processor to introduce carbon dioxide and optionally co-solvent to a solvent delivery vessel to form a cleaning medium at said single fluid phase;

means for controlling said processor to maintain said solvent delivery vessel at a second temperature and second pressure;

means for controlling said processor to purge said cleaning vessel with a purge gas prior to introduction of said cleaning medium;

means for controlling said processor to flush said cleaning vessel and said workpiece with carbon dioxide in said single fluid phase;

means for controlling said processor to introduce inert gas into said cleaning vessel after the contacting step to remove said cleaning medium; and means for controlling said processor to adjust the pressure of said cleaning vessel to atmospheric pressure.

4. The storage media of claim 3, further comprising:

means for controlling said processor to control a separator means; and means for controlling said processor to control means for condensing vapors to a liquid fluid phase.

* * * * *